US011174698B1

(12) United States Patent
Karigan

(10) Patent No.: US 11,174,698 B1
(45) Date of Patent: Nov. 16, 2021

(54) ROTATING CONTROL DEVICE ELEMENT REINFORCEMENT PETALS

(71) Applicant: HALLIBURTON ENERGY SERVICES, INC., Houston, TX (US)

(72) Inventor: Joseph Michael Karigan, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/126,620

(22) Filed: Dec. 18, 2020

(51) Int. Cl.
*E21B 33/06* (2006.01)
*E21B 33/08* (2006.01)

(52) U.S. Cl.
CPC ..... *E21B 33/085* (2013.01); *E21B 33/06* (2013.01)

(58) Field of Classification Search
CPC ..... E21B 33/06; E21B 33/085
See application file for complete search history.

(56) References Cited

U.S. PATENT DOCUMENTS 2,336,090 A * 12/1943 Granger ..... E21B 37/10 92/241
2,762,638 A 9/1956 Brown
4,428,592 A * 1/1984 Shaffer ..... E21B 33/06 251/1.2
4,441,551 A * 4/1984 Biffle ..... E21B 33/085 166/84.3
6,109,348 A * 8/2000 Caraway ..... E21B 33/085 166/84.3
7,717,168 B2 5/2010 Williams
7,735,552 B2 * 6/2010 Xu ..... E21B 33/1208 166/202
8,393,388 B2 3/2013 Bishop et al.
9,863,203 B2 1/2018 Borden et al.
9,896,900 B2 2/2018 Clarke
10,012,044 B2 7/2018 Leba et al.
10,053,943 B2 * 8/2018 Hannegan ..... E21B 33/068
10,240,422 B2 * 3/2019 Fripp ..... E21B 33/03
10,731,762 B2 * 8/2020 Trivedi ..... F16J 15/027
2018/0334876 A1 11/2018 Zonoz et al.

FOREIGN PATENT DOCUMENTS

EP 003231986 A2 10/2017
WO WO1999018323 4/1999

* cited by examiner

*Primary Examiner* — Matthew R Buck
(74) *Attorney, Agent, or Firm* — Haynes and Boone, LLP

(57) ABSTRACT

A reinforced seal for use in a rotating control device in a wellbore includes an annular elastomeric body and an internal support embedded within the elastomeric body and extending in an axial direction, the internal support comprising a plurality of overlapping petals. A system for sealing a drill string includes a rotating control device including the reinforced seal configured to accommodate the drill string therethrough.

17 Claims, 7 Drawing Sheets

ROTATING CONTROL DEVICE ELEMENT REINFORCEMENT PETALS

TECHNICAL FIELD

The present disclosure relates generally to operations performed and equipment utilized in conjunction with a subterranean well such as a well for recovery of oil, gas, or minerals. More particularly, the disclosure relates to reinforcement petals for a rotating control device (RCD) element.

BACKGROUND

Drilling operations may be performed in a variety of locations and settings. When drilling, a gap (typically referred to as an annulus) may be present between the drill string and the casing and/or outside of the wellbore. In some drilling operations, the annulus may be closed during drilling operations. Some closed annulus drilling operations may include Managed Pressure Drilling (MPD), underbalanced drilling (UBD), Pressurized Mud Cap Drilling (PMCD), Managed Pressure Cementing (MPC), mud cap drilling, air drilling, and mist drilling.

When performing closed annulus drilling operations, sealing devices are used to maintain pressure in the wellbore and to prevent unwanted fluid or pressure loss. Such sealing devices may be located at or near the wellhead and may be included in mechanisms that are installed above the wellhead, such as an RCD that assists with the delivery of pressurized fluid to the wellbore. An RCD, also referred to as a rotating drilling device, rotating drilling head, rotating flow diverter, pressure control device and rotating annular, may also function to close off the annulus around a drill string during drilling operations. The sealing mechanism of the RCD, typically referred to as a seal element or packer, is operable to maintain a dynamic seal on the annulus. The seal element may be required to accommodate equipment having various diameters, in some cases fluctuating by 65% or more.

BRIEF DESCRIPTION OF THE DRAWINGS

Embodiments are described in detail hereinafter with reference to the accompanying figures, in which.

DETAILED DESCRIPTION

Figure 1:
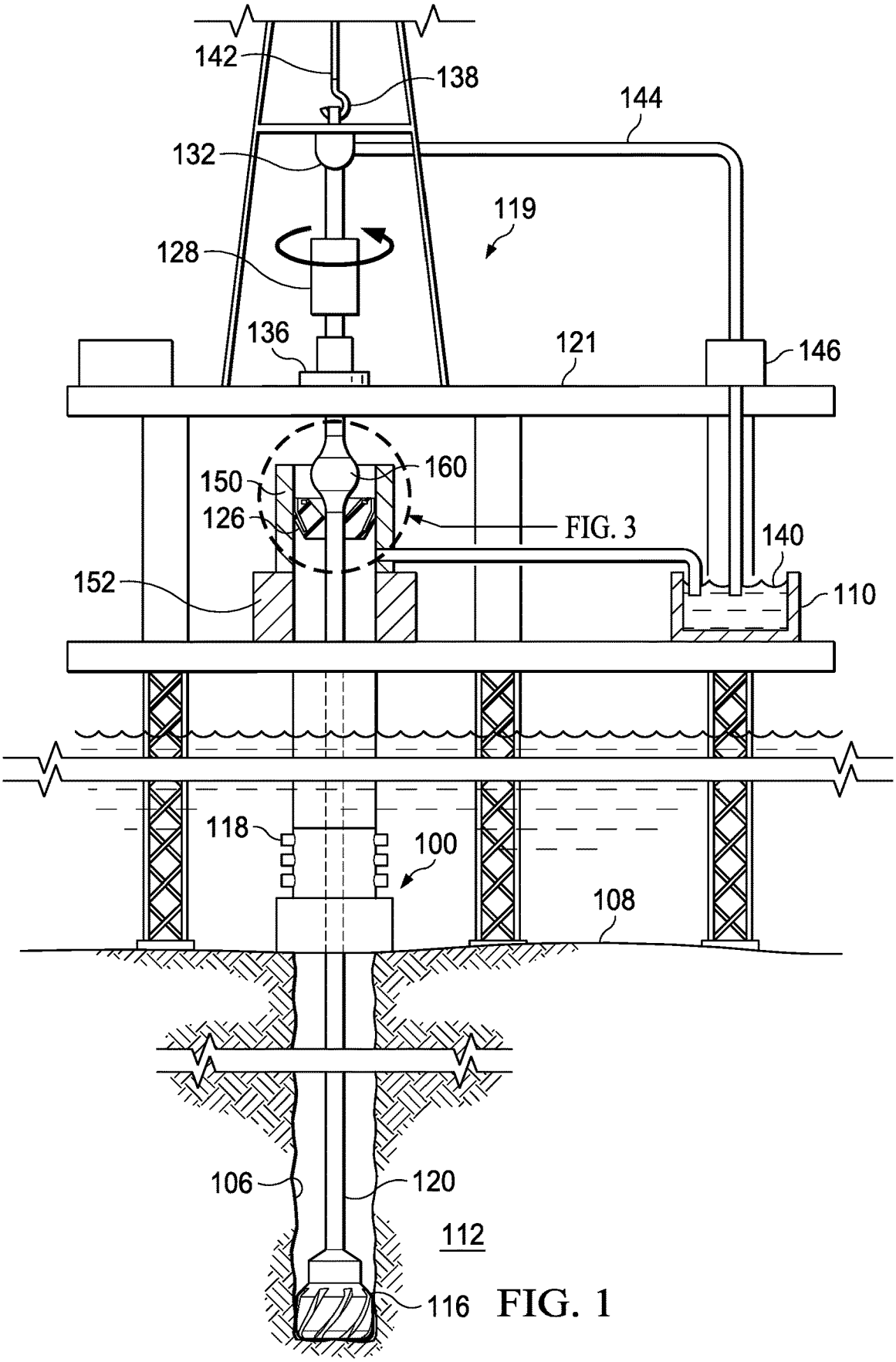
FIG. 1 is a schematic, front view of a subsea well including a drilling system according to an embodiment of the present disclosure.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. In addition, figures are not necessarily drawn to scale but are presented for simplicity of explanation.

Referring now to FIG. 1, a drilling system 100, such as an MPD or UBD system, is deployed in a well having a wellbore 106 that extends from a surface 108 of the well to or through a subterranean formation 112. In the embodiment shown in FIG. 1, the surface 108 of the well is located on the sea floor. The drilling system 100 includes components above or proximate the wellhead that function to seal the well from the external environment. The elements may include a blow-out preventer (BOP) 152 and RCD 150. The RCD 150 includes one or more bearing-mounted reinforced seals 126 that compress against a surface of a drill pipe to provide a rotating, sealed interface between the RCD 150 and the drill string 120. In some embodiments, the reinforced seal 126 may be used in a non-rotating installation. For instance, the reinforced seal 126 may be mounted on a non-rotating adapter and used to manage surface pressure while running casing or conducting MPC. The reinforced seal 126 may be flexible to allow for tool joints having an enlarged diameter relative to the normal outer diameter of the drill pipe to pass through the seal at the wellhead element as the drill pipe is lowered into a wellbore. In some embodiments, the diameter is enlarged by 65% or more compared to the outer diameter of the drill pipe.

Figure 2:
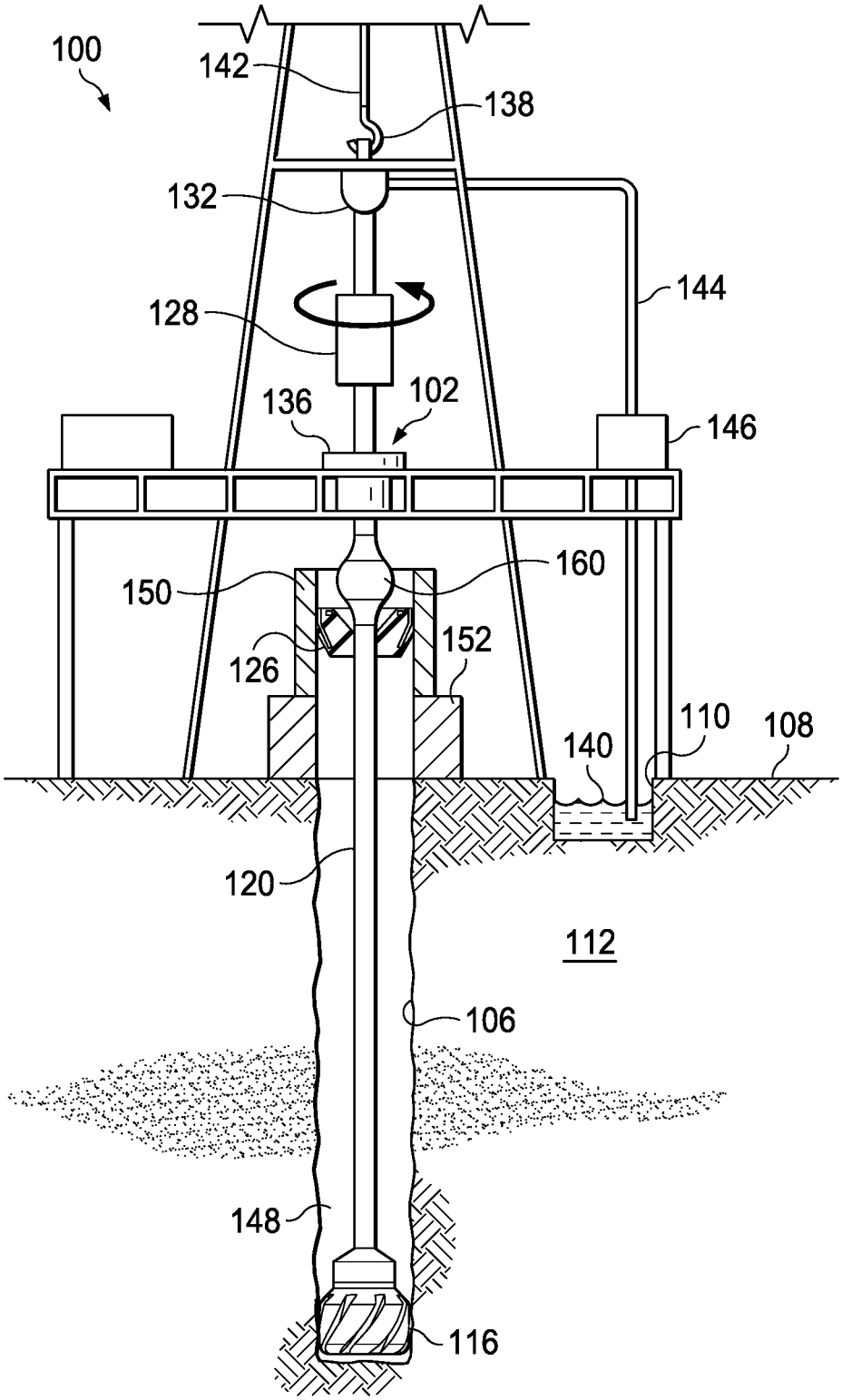
FIG. 2 is a schematic, front view of an on-shore well including a drilling system according to an embodiment of the present disclosure.

In FIG. 1, the well is illustrated in a subsea configuration, with a reinforced seal 126 included in an RCD 150 above the wellhead 118 and BOP 152. Although FIG. 1 depicts a jackup rig, the present disclosure likewise applies to other types of offshore drilling operations, such as those employing a semi-submersible or a drillship. In another embodiment, the reinforced seal 126 may be installed at a wellhead or in other locations within a wellbore where such a seal is desired. In other installations, the RCD 150 and associated reinforced seal 126 may be deployed onshore, as shown in FIG. 2. FIGS. 1 and 2 each illustrate possible implementations of a system that includes the reinforced seal 126 within a rotational control device 150. While the following description of the reinforced seal 126 focuses primarily on the use of the reinforced seal 126 within an RCD 150 in the subsea well of FIG. 1, the reinforced seal 126 may be used instead in the well configurations illustrated in FIG. 2, as well as in other well configurations where it is desirable to include an RCD 150 having a robust fluid seal. The reinforced seal 126 may also be useful downhole in a completion string to separate pressure zones in a well after the completion of drilling activities. Similar components in FIGS. 1 and 2 are identified with similar reference numerals.

The well is formed by a drilling process in which a drill bit 116 is turned a drill string 120 that extends from the drill bit 116 to the surface 108 of the well. The drill string 120 may refer to the collection of pipes or tubes as a single component, or alternatively to the individual pipes or tubes (drill pipes) and tooling connections that make up the drill string 120. The term drill string may refer to any component or components that are capable transferring rotational energy from the surface of the well to the drill bit 116. In several embodiments, the drill string 120 may include a central passage (bore) disposed longitudinally in the drill string 120 and capable of allowing fluid communication between the surface 108 of the and downhole locations. The drill string 120 may include a number of tool joints 160 that, when viewed as an external profile, appear as sections of drill string 120 having an enlarged outer diameter. The tool joints 160 may correspond to tool locations or other junctions within the drill string 120.

At or near the surface 108 of the well, the drill string 120 may include or be coupled to a top drive 128, which is connected at one end to the remainder of the drill string 120 and at an opposite end to a rotary swivel 132. The top drive 128 is capable of rotating the drill string 120 and drill bit 116. The rotary swivel 132 allows the top drive 128 to rotate without rotational motion being imparted to the rotary cable 142. A hook 138, the cable 142, a traveling block (not shown), and a hoist (not shown) are provided to lift or lower the drill bit 116, drill string 120, top drive 128 and rotary swivel 132. The top drive 128 and rotary swivel 132 may be raised or lowered as needed to add additional sections of tubing to the drill string 120 as the drill bit 116 advances, or to remove sections of tubing from the drill string 120 if removal of the drill string 120 and drill bit 116 from the well is desired. In some embodiments, a rotary table 136 or other equipment associated with rotation and/or translation of the drill string 120 may be included.

As noted above, the drilling system 100 includes RCD 150, which functions to seal the system, diverts flow away from the rig floor into the wellbore 106, and complements the rig's standard BOP 152. The RCD 150 forms a friction seal around the drill string 120 to create a closed loop drilling system. The RCD 150 may be configured to seal against and withstand a preselected static pressure differential. For example, the preselected static pressure differential may be 1,000, 2,500, or 5,000 psi. The RCD 150 may also include a dual stripper, or second reinforced seal 126, to create a secondary barrier for safer operation. In addition to MPD and UBD configurations, the RCD may also be used in conventional overbalanced drilling as an extra layer of protection against kicks. In one or more embodiments, the RCD 150 is located above BOP 152, which is may be above surface 108, or above the water line in off-shore applications.

As shown in FIGS. 1 and 2, in normal operation, drilling fluid 140 is stored in a drilling fluid reservoir 110 and pumped into an inlet conduit 144 using a choke 146 that includes a pump, or plurality of pumps disposed along the inlet conduit 144. Drilling fluid 140 passes through the inlet conduit 144 and into the drill string 120 via a fluid coupling at the rotary swivel 132. The drilling fluid 140 is circulated into the drill string 120 to maintain pressure in the drill string 120 and wellbore 106 and to lubricate the drill bit 116 as it cuts material from the formation 112 to deepen or enlarge the wellbore 106. After exiting the drill string 120, the drilling fluid 140 carries cuttings from the drill bit 116 back to the surface 108 through an annulus 148 formed by the space between the inner wall of the wellbore 106 and outer wall of the drill string 120. At the RCD 150, the drilling fluid 140 exits the annulus 148 and is directed out of side ports in the RCD 150 to a repository. If the drilling fluid 140 is recirculated through the drill string 120, the drilling fluid 140 may return to the drilling fluid reservoir 110 via an outlet conduit 164 that couples the annulus 148 to the drilling fluid reservoir 110. The path that the drilling fluid 140 follows from the reservoir 110, into and out of the drill string 120, through the annulus 148, and to the repository may be referred to as the fluid flow path.

The reinforced seal 126 is configured to create a fluid seal against the drill string 120 to prevent the unwanted egress of drilling fluid or other fluids from the wellbore 106. According to one or more embodiments, the reinforced seal 126 is configured to seal against a desired pressure differential across the RCD 150, such as that discussed above. During drilling operations, the drill string 120 is run down through the center of the reinforced seal 126, which is mounted to a bearing to facilitate rotation of the drill string 120. A seal between the drill string 120 and the reinforced seal 126 may be created and maintained by compressing a surface of a drill pipe against a complementary surface of the reinforced seal 126. The reinforced seal 126 may be relied upon to hold a pressure differential and may be mechanically robust to allow expansion so that tool joint 160 may pass through the seal.

Figure 3:
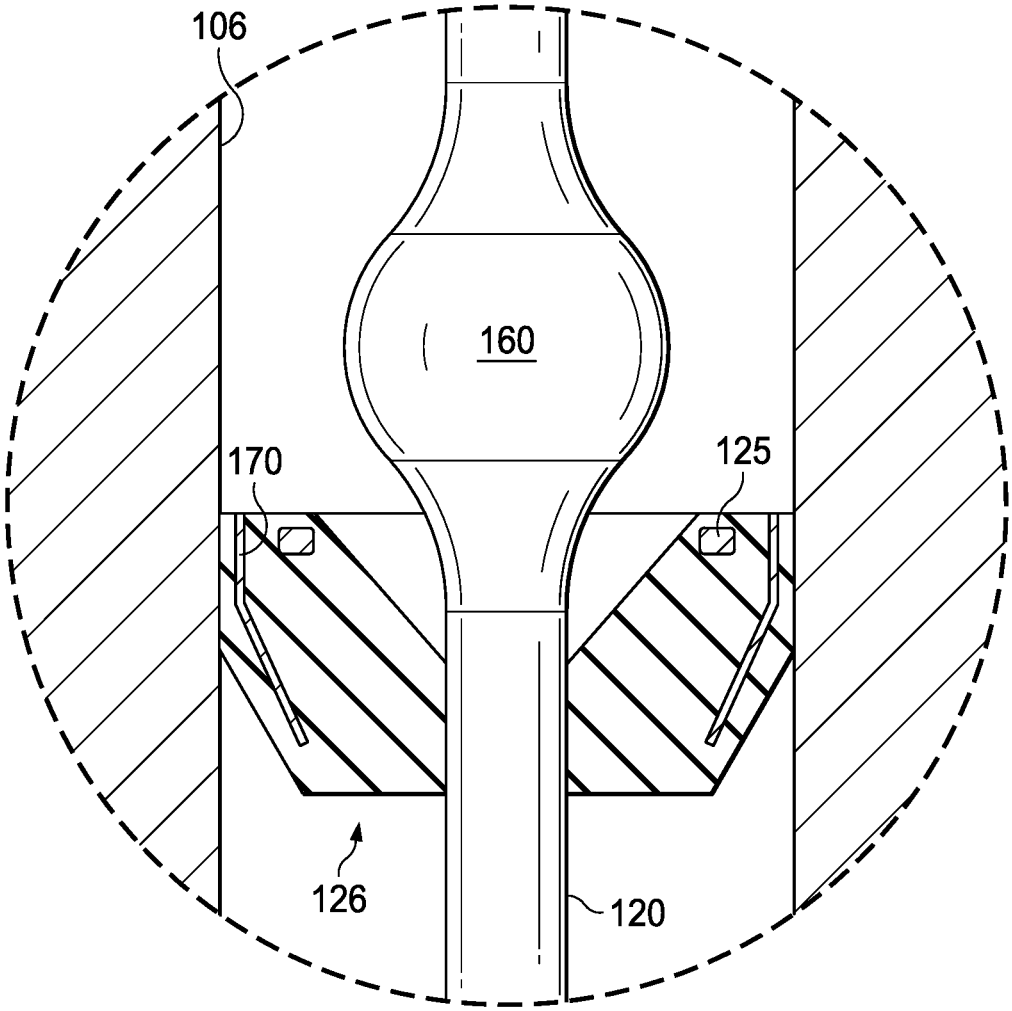
FIG. 3 is a detail view, in partial cross-section, showing an embodiment of a reinforced seal downhole from a tool joint of a drill string, a representative location of which is indicated in FIG. 1.

Referring to FIG. 3, while the reinforced seal 126 may be primarily comprised of an elastomer, a seal that is formed only from elastomer may fail at high pressure differentials. To prevent such undesired failures, a metal backup ring 125 may be bonded to the elastomer to reinforce the seal 126. The metal backup ring 125 is generally sized larger than any tool joint 160 or other component that is to be passed through the reinforced seal 126.

To further prevent failures, the reinforced seal 126 includes an internal support 170 capable of expanding and contracting with the reinforced seal 126. The internal support 170 extends axially within the reinforced seal 126. In FIG. 3, the reinforced seal 126 is in a first configuration wherein an inner diameter thereof is sealed against an outer diameter of a drill pipe of the drill string 120.

Figure 4:
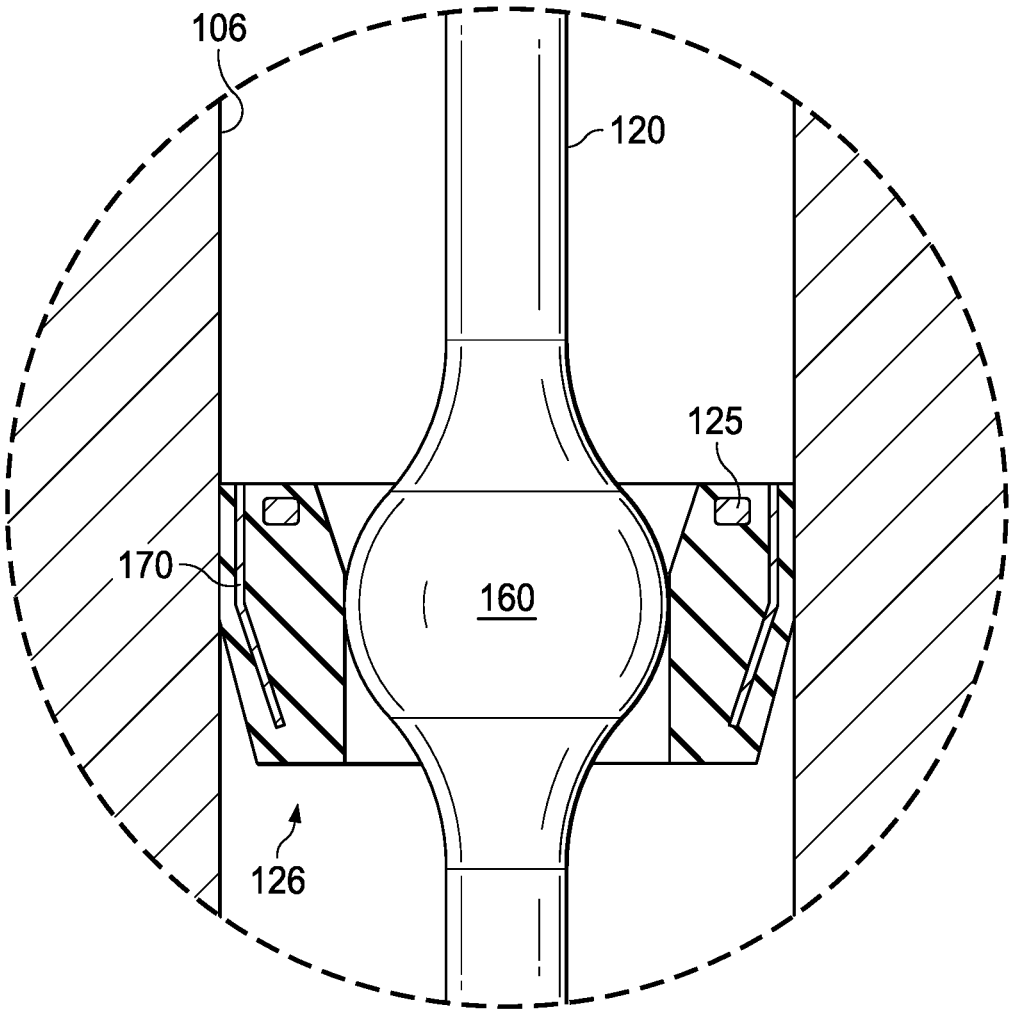
FIG. 4 is a side view, analogous to the detail view of FIG. 3, showing the tool joint passing through the reinforced seal according to an embodiment of the present disclosure.

Turning to FIG. 4, as a wider portion of the drill string 120, such as tool joint 160 passes through the reinforced seal 126, an inner diameter of the reinforced seal 126 expands in a second configuration to accommodate the tool joint 160. The internal support 170 likewise flexes and expands with the reinforced seal 126 in the second configuration. Once the tool joint 160 passes, the reinforced seal 126 returns to its first configuration to again seal against the smaller diameter of the drill pipe.

Figure 5:
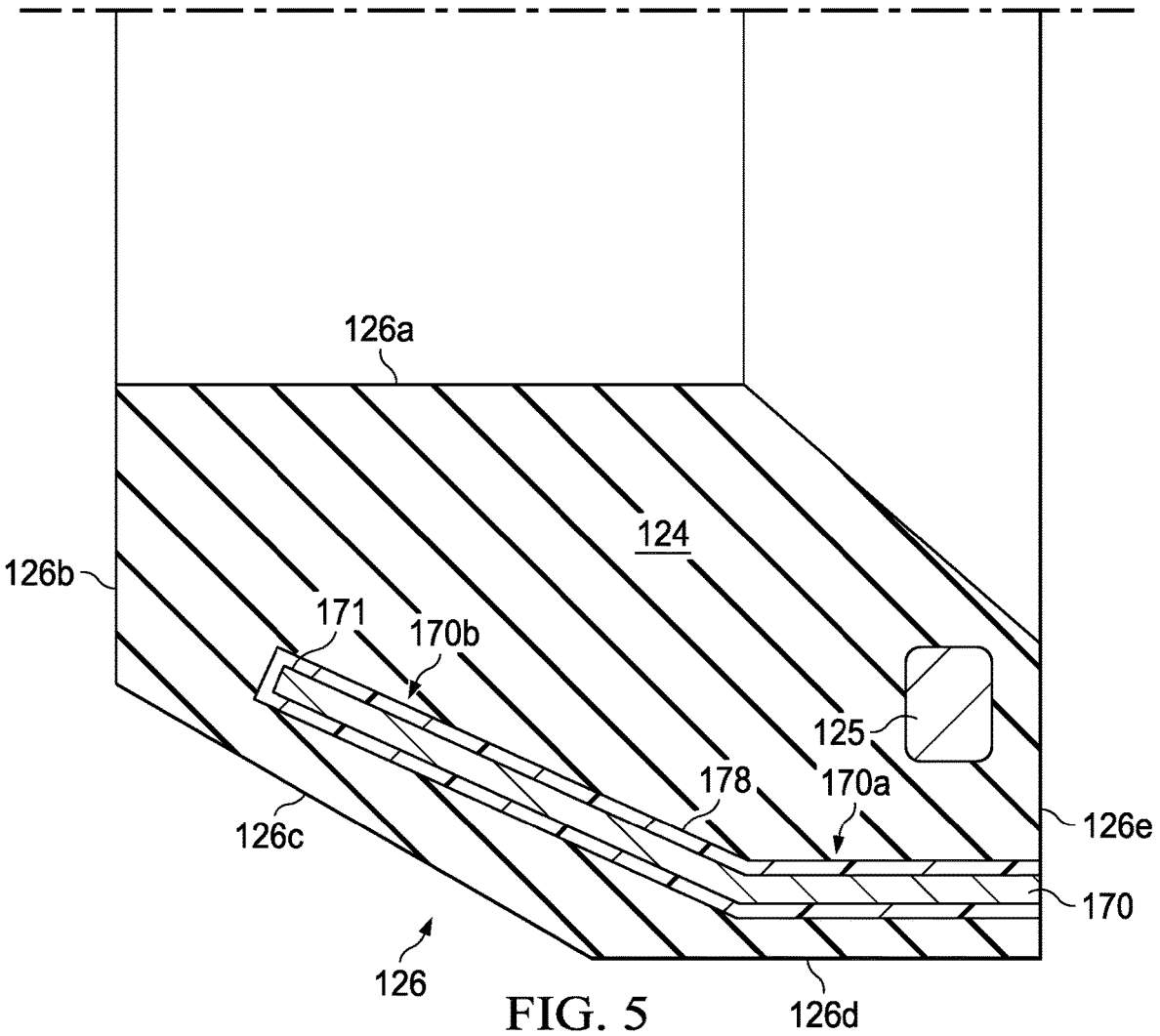
FIG. 5 is a cross-sectional view of a reinforced seal according to an embodiment of the present disclosure.

Turning to FIG. 5, the reinforced seal 126 is formed primarily of an elastomer 124, which forms an annular donut shape. The elastomer material is not particularly limited and may be selected in view of the use pressures and temperatures of the reinforced seal 126. In one or more embodiments, the metal backup ring 125 discussed above is located proximate an uphole end **126*e* of the reinforced seal 126. The metal backup ring 125** may be formed from, e.g., steel, titanium, or any other suitable metal.

The internal support 170 comprises two or more support petals 171. In some embodiments, the internal support 170 comprises at least 3, at least 5, at least 7, at least 10, or at least 15 support petals. The support petals 171 may be formed of any suitable material that is capable of flexing with the reinforced seal 126. In one or more embodiments, the support petals 171 are formed of aluminum, titanium, steel alloy, polymer, plastic, ceramic, or any other suitable material. In one or more embodiments, the support petals 171 are sufficiently thin to allow the reinforced seal 126 to flex and accommodate tools or parts having differing diameters. Thin metal flexibility allows the support petals 171 to be beneficially integrated with the base elastomer without intense stress concentration that would occur when using rigid and/or thick metals. Such stress concentration often initiates a failure that may propagate through rest of the reinforced seal 126. According to one or more embodiments, the support petals 171 are present around an entire circumference of the reinforced seal 126.

In one or more embodiments, the internal support 170 is anchored to the metal backup ring 125. For instance, each of the support petals 171 may be welded to, wrapped around, or otherwise attached or affixed to the metal backup ring 125. In such embodiments, a casing 178 may be included and may encase a portion of the support petals 171 not in contact with the metal backup ring 125.

In some embodiments, the internal support 170 has a bent profile in the first and/or second configurations discussed above, wherein the angle of the bend decreases from the first configuration to the second configuration as the internal support 170 expands. The bent profile may include a first portion 170*a* proximate the uphole end 126*e* of the reinforced seal 126 that is substantially parallel with an outer side 126*d* of the reinforced seal 126, which may be parallel to sides of the wellbore 106. Extending at an angle from the first portion 170*a* is a second portion 170*b* of the internal support 170. The angle may be approximately equal to the angle between sides 126*c* and 126*d* of the reinforced seal. In some embodiments, the angle between the first portion 170*a* and the second portion 170*b* is 0 to 60 degrees, greater than 0 to 45 degrees, 5 to 40 degrees, 15 to 30 degrees, or any logical combination of foregoing limits. In some embodiments, the internal support 170 is straight in either or both of the first and second configurations.

In one or more embodiments, the internal support 170 is entirely embedded within the elastomer 124. In some embodiments, the internal support 170 is spaced from an inner surface 126*a*, a downhole end 126*b*, and outer surfaces 126*c* and 126*d* by 1 inch or more. In some embodiments, the internal support is disposed closer to outer surfaces 126*c* and 126*d* than inner surface 126*a*.

In one or more embodiments, the internal support 170 further comprises a casing 178 surrounding at least a portion of the support petals 171. The casing 178 acts as a barrier between the support petals 171 and the elastomer 124 of the reinforced seal 126, thereby reducing wear and potential tearing caused by movement of the support petals 171. In one or more embodiments, the casing 178 fully encases the support petals 171. Fully encasing the support petals 171 with the casing 178 isolates potential pinching points from the elastomer 124 to thereby reduce wear and provides complete reinforcement of the internal support 170. The casing 178 may be formed of a flexible material capable of moving with the reinforced seal 126 and expanding as the internal support 170 expands. In one or more embodiments, the casing is formed of a carbon fiber fabric or mesh or a metal mesh. In some embodiments, the casing 178 may include two or more layers of carbon fiber fabric or mesh or metal mesh. The casing 178 can effectively binding, ripping, and tearing between the support petals 171 and the elastomer 124.

Figure 6:
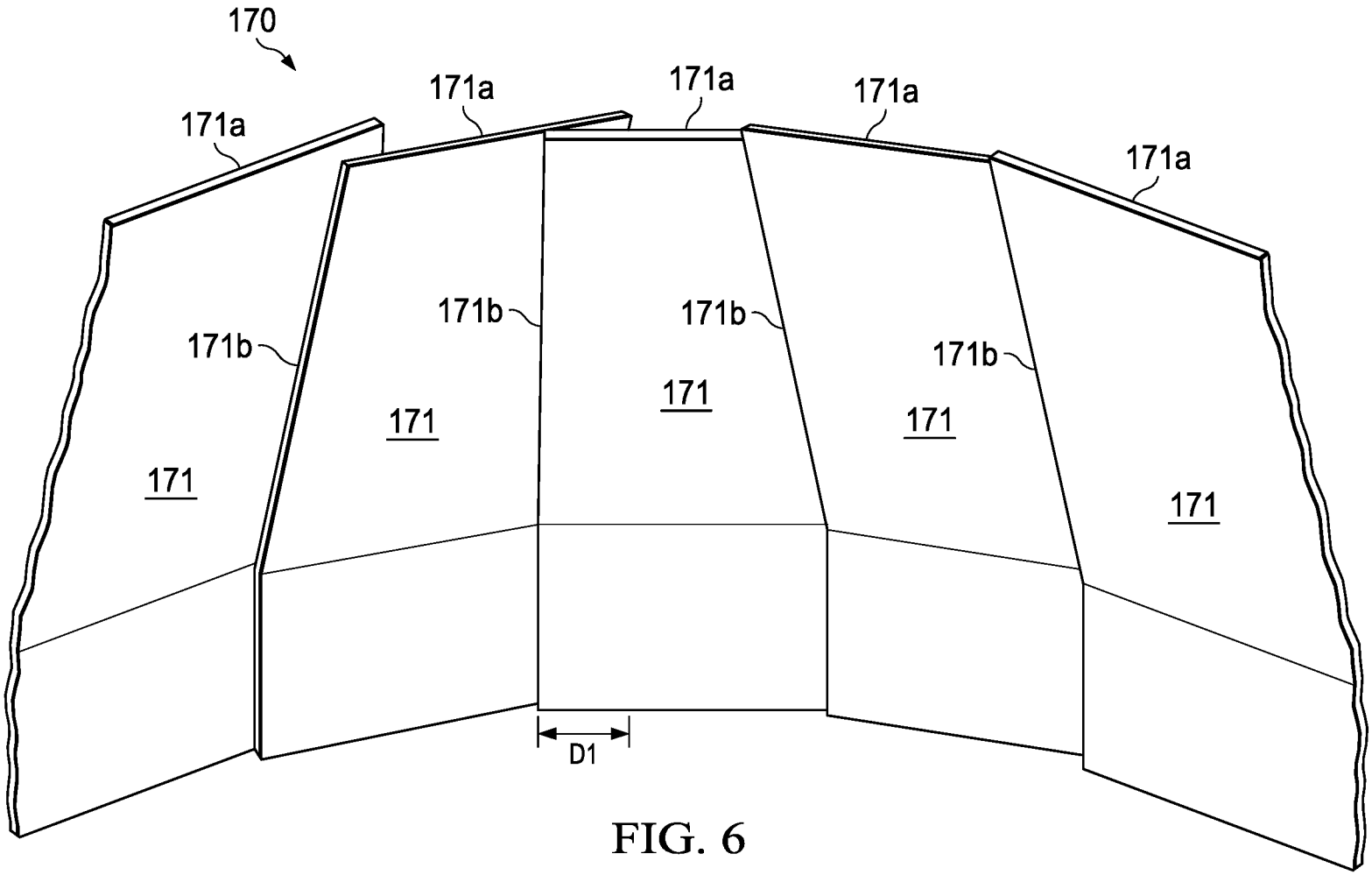
FIG. 6 is a side view of reinforcing petals according to an embodiment of the present disclosure.

Turning to FIG. 6, an array of the support petals 171 of the internal support 170 is shown without any casing 178. An inner edge 171*b* of each support petal 171 overlaps and outer edge 171*a* of an adjacent support petal 171 by a distance of D1, which is greater than 0. The overlap distance between adjacent sets of support petals 171 may be uniform or may vary, e.g., during operation of the reinforced seal 126 due to uneven friction between the respective support petals 171. Additionally, the overlap distance between one set of adjacent support petals 171 may be uniform or may vary along a length of the support petals 171. For example, the shape or relative positions of the support petals 171 may cause a greater overlap at the uphole end, the downhole end, or somewhere in between. In some embodiments, the support petals 171 may be rectangular, square, triangular, trapezoidal, or any other suitable shape, such as a regular or irregular polygon. In some embodiments, the downhole ends of the support petals 171 overlap by a greater distance than the uphole ends of the support petals 171 in the first configuration. In the second configuration, this difference is reduced, i.e., the overlap at the downhole ends is reduced to a greater degree than that at the uphole ends when going from the first configuration (smaller diameter) to the second configuration (larger diameter). This allows for a greater degree of expansion at the downhole end of the internal support 170.

Figure 7:
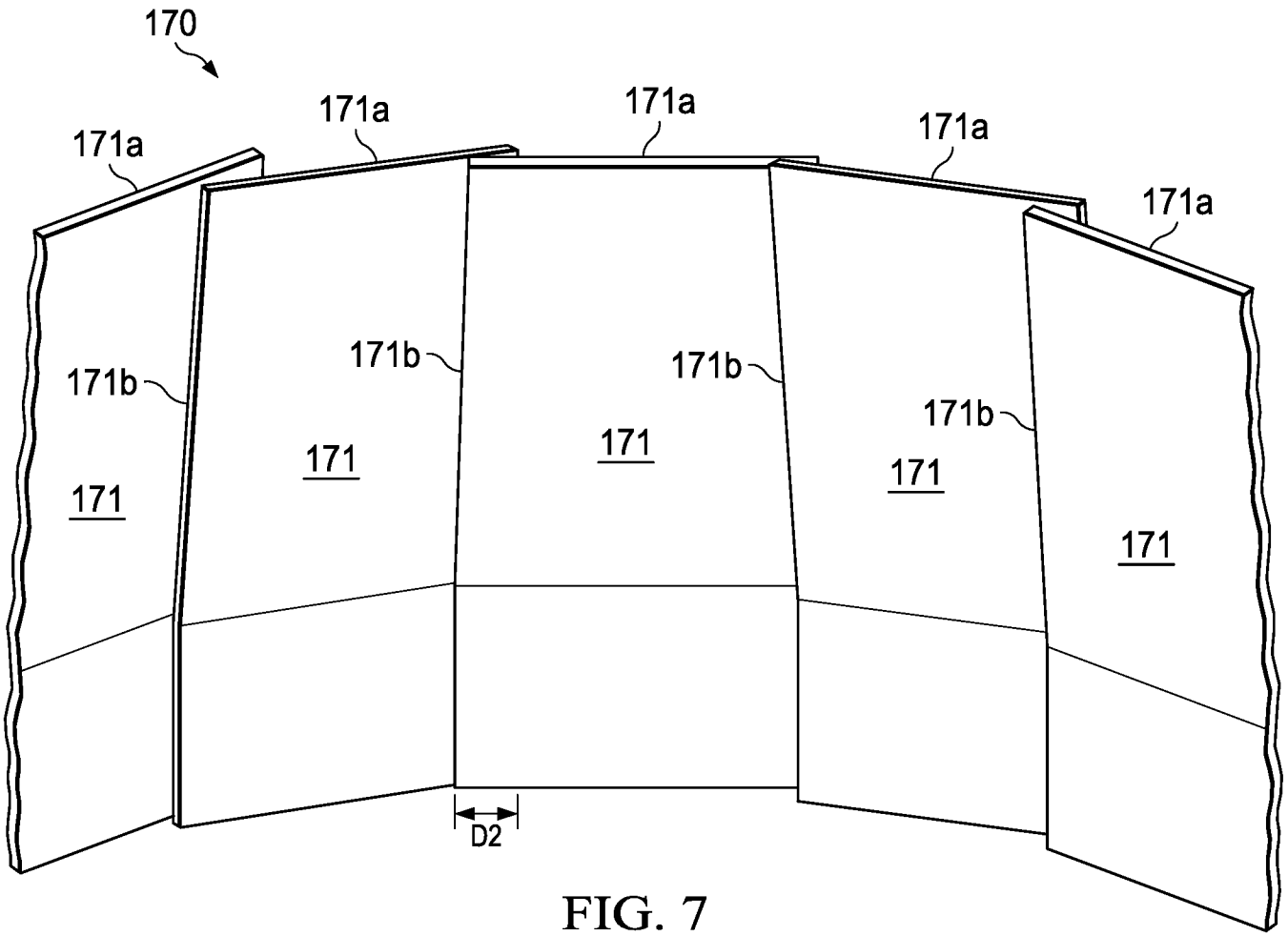
FIG. 7 is a side view of the reinforcing petals of FIG. 6 flexing or spreading according to an embodiment of the present disclosure.

Referring to FIG. 7, when the internal support 170 is in the second configuration, such as that shown in FIG. 4, the overlap distance D2 is decreased compared to distance D1. The decrease may be uniform along the length of the support petals 171 or may vary. The decrease is due to the expansion of the internal support 170 and reinforced seal 126 causing the support petals 171 to spread. In the second configuration, the adjacent support petals 171 may be overlap evenly along a length of the support petals 171 or the overlap distance may vary. Additionally, as in the first configuration, in the second configuration, the overlap distances of respective adjacent support petals 171 may be equal or vary.

In one or more embodiments, in both the first and second configurations, the support petals 171 overlap along an entire length thereof. Such a configuration avoids creating pinch points that could catch the casing 178 and/or portions of the elastomer 124, thereby compromising the integrity of the reinforced seal 126 over time. By overlapping the support petals 171, complete reinforcement can be achieved while allowing sufficient flexibility to seal on multiple pipe/tool joint diameters.

According to one or more embodiments, the reinforced seal 126 includes a plurality of internal supports 170 layered within the elastomer 124. In some embodiments, the internal support 170 maybe include a plurality of layers of support petals 171, wherein all of said layers may be encased by a single casing 178. Multiple layers of internal supports 170 or multiple layers of support petals 171 may be necessary to achieve higher strength while still taking advantage of the thin sheet elastic flexibility.

Embodiments of the present disclosure allow the reinforced seal 126 to be employed in higher temperatures and under higher pressure differentials than conventional seals. This added capability enables MPD or UBD systems to be employed in wells that could not previously use such technology. Further, the reinforced seal 126 of the present disclosure enables increased operational windows in any application due to its improved resilience.

The reinforced seal 126 may be included in a system for sealing the drill string 120. The system may include any number of components from the drilling system 100. In some embodiments, the system includes the drill string 120 and the RCD 150. The RCD 150, including reinforced seal 126, has been described in detail above. In some embodiments, the system may include a second drill string.

Also provided herein is a method for sealing the drill string 120. The method includes providing the RCD 150 proximate the wellhead 118 in the wellbore. In some embodiments, the providing step includes positioning the RCD 150 above the wellhead 118 and the BOP 152. The RCD 150 comprises the reinforced seal 126, as described in detail above. After providing the RCD 150, the method further comprises inserting a first portion of the drill string 120 through the reinforced seal 126. The method may further comprise inserting a second portion of the drill string 120 into the reinforced seal, wherein the first portion has a first diameter and the second portion has a second diameter that is different from the first portion. For instance, the first portion may be a length of the drill pipe having a smaller diameter than a second portion being a tool joint 160. In other embodiments, the first portion may have a larger diameter than the second portion.

In one or more embodiments, the reinforced seal 126 and the internal support 170 expand and/or contract to seal against the first and second portions of the drill string 120. When the first portion of the drill string 120 is within the reinforced seal 126, the reinforced seal 126 and internal support 170 are in a first configuration. When the second portion of the drill string 120 is within the reinforced seal 126, the reinforced seal 126 and internal support are in a second configuration that is different from the first configuration. In some embodiments, the internal support 170 has a bent profile in the first and/or second configurations, wherein the angle of the bend decreases or increases from the first configuration to the second configuration as the internal support 170 expands or contracts.

In some embodiments, the method may further comprise inserting a third portion of the drill string 120 into the reinforced seal 126, wherein the third portion has a third diameter equal to the first diameter. In such embodiments, the reinforced seal 126 and internal support are in a third configuration when the third portion is within the reinforced seal 126, and the third configuration is substantially the same as the first configuration discussed above. For instance, the bent profile of the internal support 170 may be substantially the same in each of the first and third configurations.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Thus, a reinforced seal for use in a rotating control device in a wellbore has been described. Embodiments of the reinforced seal may generally include an annular elastomeric body and an internal support embedded within the elastomeric body and extending in an axial direction, the internal support comprising a plurality of overlapping petals. For any of the foregoing embodiments, the reinforced seal may include any one of the following elements, alone or in combination with each other:

- The reinforced seal wherein the internal support further comprises a casing surrounding the plurality of petals.
- The reinforced seal wherein the casing comprises a fabric or mesh.
- The reinforced seal wherein the petals comprise thin sheets of aluminum, titanium, steel alloy, plastic, and/or ceramic.
- The reinforced seal wherein the petals are trapezoidal, each having a short parallel side of the trapezoid positioned at an uphole end of the seal and a long parallel side of the trapezoid positioned at a downhole end of the reinforced seal.
- The reinforce seal wherein the internal support has a bent profile comprising: a first portion positioned at an uphole end of the reinforced seal and parallel to a central axis of the annular elastomeric body; and a second portion extending from the first portion an angle of greater than 0 to 60 degrees toward the central axis.
- The reinforced seal wherein the plurality of overlapping petals comprises: a first petal having a lead edge extending in the axial direction; a second petal adjacent the first petal and having a trailing edge extending in the axial direction; wherein the lead edge of the first petal overlaps the trailing edge of the second petal along an entire axial length of the first and second petals.

Thus, a system for sealing a drill string has been disclosed. The system may generally include a rotating control device comprising a reinforced seal configured to accommodate the drill string therethrough; wherein the reinforced seal comprises: an annular elastomeric body; and an internal support embedded within the elastomeric body and extending in an axial direction, the internal support comprising a plurality of overlapping petals. For any of the foregoing embodiments, the system may include any one of the following elements, alone or in combination with each other:

- The system wherein the drill string comprises parts having variable diameters, wherein a largest diameter part has a diameter at least 1.5 times a diameter of a smallest diameter part.
- The system wherein the plurality of overlapping petals comprises: a first petal having a lead edge extending in the axial direction; a second petal adjacent the first petal and having a trailing edge extending in the axial direction; wherein the lead edge of the first petal overlaps the trailing edge of the second petal along an entire axial length of the first and second petals; wherein, at a downhole end of the internal support, the lead edge overlaps the trailing edge by a first distance when the smallest diameter part is within the reinforced seal and by a second distance when the largest diameter part is within the reinforced seal; and wherein the first distance is larger than the second distance.
- The system wherein the petals are trapezoidal, each having a short parallel side of the trapezoid positioned at an uphole end of the seal and a long parallel side of the trapezoid positioned at a downhole end of the reinforced seal.
- The system wherein the plurality of overlapping petals is fully encased by a casing layer.
- The system wherein the casing layer comprises a fabric or mesh.

Thus, a method of sealing a drill string has been disclosed. The method may generally include providing a rotating control device proximate a wellhead in a wellbore, the rotating control device comprising a reinforced seal; and inserting a first portion of the drill string through the reinforced seal; wherein the reinforced seal comprises an annular elastomeric body and an internal support embedded within the elastomeric body and extending in an axial direction, the internal support comprising a plurality of overlapping petals. For any of the foregoing embodiments, the method may include any one of the following elements, alone or in combination with each other:

The method wherein the first portion of the drill string has a first diameter; the method further comprises inserting a second portion of the drill string through the reinforced seal; wherein the second portion has a second diameter that is larger than the first diameter.

The method wherein the plurality of overlapping petals comprises: a first petal having a lead edge extending in the axial direction; a second petal adjacent the first petal and having a trailing edge extending in the axial direction; wherein the lead edge of the first petal overlaps the trailing edge of the second petal along an entire axial length of the first and second petals; wherein, at a downhole end of the internal support, the lead edge overlaps the trailing edge by a first distance when the first portion is inserted through the reinforced seal and by a second distance when the second portion is inserted through the reinforced seal; and wherein the first distance is larger than the second distance.

The method wherein the plurality of overlapping petals is fully encased by a casing layer.

The method wherein the casing layer comprises a fabric or mesh.

The method of wherein the petals comprise thin sheets of aluminum, titanium, steel alloy, plastic, and/or ceramic.

The method wherein providing the rotating control device comprises providing the rotating control device above a blow-out preventer.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

It is understood that variations may be made in the foregoing without departing from the scope of the disclosure. In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

What is claimed is:

1. A reinforced seal for use in a rotating control device in a wellbore, the reinforced seal comprising:

an annular elastomeric body;

an internal support embedded within the elastomeric body and extending in an axial direction, the internal support comprising a plurality of overlapping petals; and a casing surrounding the plurality of petals and isolating the plurality of petals from the elastomeric body.

2. The reinforced seal of claim 1, wherein the casing comprises a fabric or mesh.

3. The reinforced seal of claim 1, wherein the petals comprise thin sheets of aluminum, titanium, steel alloy, plastic, and/or ceramic.

4. The reinforced seal of claim 3, wherein the petals are trapezoidal, each having a short parallel side of the trapezoid positioned at an uphole end of the reinforced seal and a long parallel side of the trapezoid positioned at a downhole end opposite the uphole end.

5. The reinforce seal of claim 1, wherein the internal support has a bent profile comprising:

a first portion positioned at an uphole end of the reinforced seal and parallel to a central axis of the annular elastomeric body; and a second portion extending from the first portion an angle of greater than 0 to 60 degrees toward the central axis.

6. The reinforced seal of claim 1, wherein the plurality of overlapping petals comprises:

a first petal having a lead edge extending in the axial direction; and a second petal adjacent the first petal and having a trailing edge extending in the axial direction; and wherein the lead edge of the first petal overlaps the trailing edge of the second petal along an entire axial length of the first and second petals.

7. A system for sealing a drill string, the system comprising:

a rotating control device comprising a reinforced seal configured to accommodate the drill string therethrough;

wherein the reinforced seal comprises:

an annular elastomeric body;

an internal support embedded within the elastomeric body and extending in an axial direction, the internal support comprising a plurality of overlapping petals; and a casing surrounding the plurality of petals and isolating the plurality of petals from the elastomeric body.

8. The system of claim 7, wherein the drill string comprises a first portion having a first diameter and a second portion having a second diameter, wherein the first diameter is at least 1.5 times the second diameter.

9. The system of claim 8, wherein the plurality of overlapping petals comprises:

a first petal having a lead edge extending in the axial direction;

a second petal adjacent the first petal and having a trailing edge extending in the axial direction;

wherein the lead edge of the first petal overlaps the trailing edge of the second petal along an entire axial length of the first and second petals;

wherein, at a downhole end of the internal support, the lead edge overlaps the trailing edge by a first distance when the second portion is within the reinforced seal and by a second distance when the first portion is within the reinforced seal; and wherein the first distance is larger than the second distance.

10. The system of claim 9, wherein the petals are trapezoidal, each having a short parallel side of the trapezoid positioned at an uphole end of the reinforced seal and a long parallel side of the trapezoid positioned at a downhole end opposite the uphole end.

11. The system of claim 7, wherein the casing layer comprises a fabric or mesh.

12. A method of sealing a drill string, the method comprising:

providing a rotating control device proximate a wellhead in a wellbore, the rotating control device comprising a reinforced seal; and inserting a first portion of the drill string through the reinforced seal;

wherein the reinforced seal comprises an annular elastomeric body and an internal support embedded within the elastomeric body and extending in an axial direction, the internal support comprising a plurality of overlapping petals and a casing surrounding the plurality of petals and isolating the plurality of petals from the elastomeric body.

13. The method of claim 12, wherein the first portion of the drill string has a first diameter;

wherein the method further comprises inserting a second portion of the drill string through the reinforced seal; and wherein the second portion has a second diameter that is larger than the first diameter.

14. The method of claim 13, wherein the plurality of overlapping petals comprises:

a first petal having a lead edge extending in the axial direction;

a second petal adjacent the first petal and having a trailing edge extending in the axial direction;

wherein the lead edge of the first petal overlaps the trailing edge of the second petal along an entire axial length of the first and second petals;

wherein, at a downhole end of the internal support, the lead edge overlaps the trailing edge by a first distance when the first portion is inserted through the reinforced seal and by a second distance when the second portion is inserted through the reinforced seal; and wherein the first distance is larger than the second distance.

15. The method of claim 12, wherein the casing layer comprises a fabric or mesh.

16. The method of claim 12, wherein the petals comprise thin sheets of aluminum, titanium, steel alloy, plastic, and/or ceramic.

17. The method of claim 12, wherein providing the rotating control device comprises providing the rotating control device above a blow-out preventer.

* * * * *